United States Patent [19]

Curtis

[11] 4,213,267

[45] Jul. 22, 1980

[54] COMPOSITE BALLOON FIGURE AND METHOD OF MAKING THE SAME

[76] Inventor: Eugene E. Curtis, 708 S. Byrne Rd., Toledo, Ohio 43609

[21] Appl. No.: 1

[22] Filed: Jan. 2, 1979

[51] Int. Cl.[2] ..... A63H 3/06

[52] U.S. Cl. ..... 46/87

[58] Field of Search ..... 46/87, 88, 89, 90

[56] References Cited

U.S. PATENT DOCUMENTS

| | | | |
|---|---|---|---|
| 1,220,874 | 3/1917 | Miller | 46/90 |
| 1,551,986 | 9/1925 | Ferretti | 46/90 |

FOREIGN PATENT DOCUMENTS

| | | | |
|---|---|---|---|
| 810660 | 3/1937 | France | 46/87 |
| 893680 | 4/1962 | United Kingdom | 46/87 |

*Primary Examiner*—Louis G. Mancene
*Assistant Examiner*—Mickey Yu
*Attorney, Agent, or Firm*—Wilson, Fraser, Barker & Clemens

[57] ABSTRACT

The method of forming a composite balloon figure having a small balloon within a parent balloon and the resultant product.

3 Claims, 8 Drawing Figures

COMPOSITE BALLOON FIGURE AND METHOD OF MAKING THE SAME

BACKGROUND OF THE INVENTION

1. Field of the Invention

The present invention relates generally to balloon figures typically used in entertainment services, such as, for example parties, club meetings, carnivals, fairs, and the like.

SUMMARY OF THE INVENTION

The present invention concerns the formation of a composite balloon figure having at least one small balloon within a parent balloon such that the balloon contained within the parent balloon is visible from the exterior of the parent balloon. The method of the present invention comprises the steps of inflating and sealing the parent balloon and thereafter squeezing a portion of the parent balloon together to form a second discrete balloon connected to the parent balloon by an interface region. The interface region is of a substantially smaller cross-section than the parent balloon and is compressively substantially sealed so as to minimize passage of air between the two balloons. Thereafter, the second balloon is moved inwardly into the interior cavity of the parent balloon until the second balloon is entirely encased by the parent balloon. Next, the skin of the parent balloon disposed adjacent the outer end of the inserted second balloon is torn, cut, or otherwise disengaged from the second balloon and from the parent balloon to allow the second balloon to move freely within the cavity of the parent balloon. The parent balloon is quickly sealed to provide an inflated parent balloon containing the smaller second balloon in its interior cavity.

It is an object of the present invention to produce a method for the manufacture of composite balloon structures.

Another object of the present invention to produce a method for the rapid fabrication of a composite balloon structure comprised of one balloon within another.

Still another object of the invention is to produce a composite balloon structure comprised of one balloon within another.

BRIEF DESCRIPTION OF THE DRAWINGS

The above objects and advantages of the invention will become readily apparent to one skilled in the art from reading the following detailed description of a preferred embodiment of the invention, when considered in the light of the accompanying drawings, in which.

DETAILED DESCRIPTION OF THE PREFERRED EMBODIMENT

Figure 1:
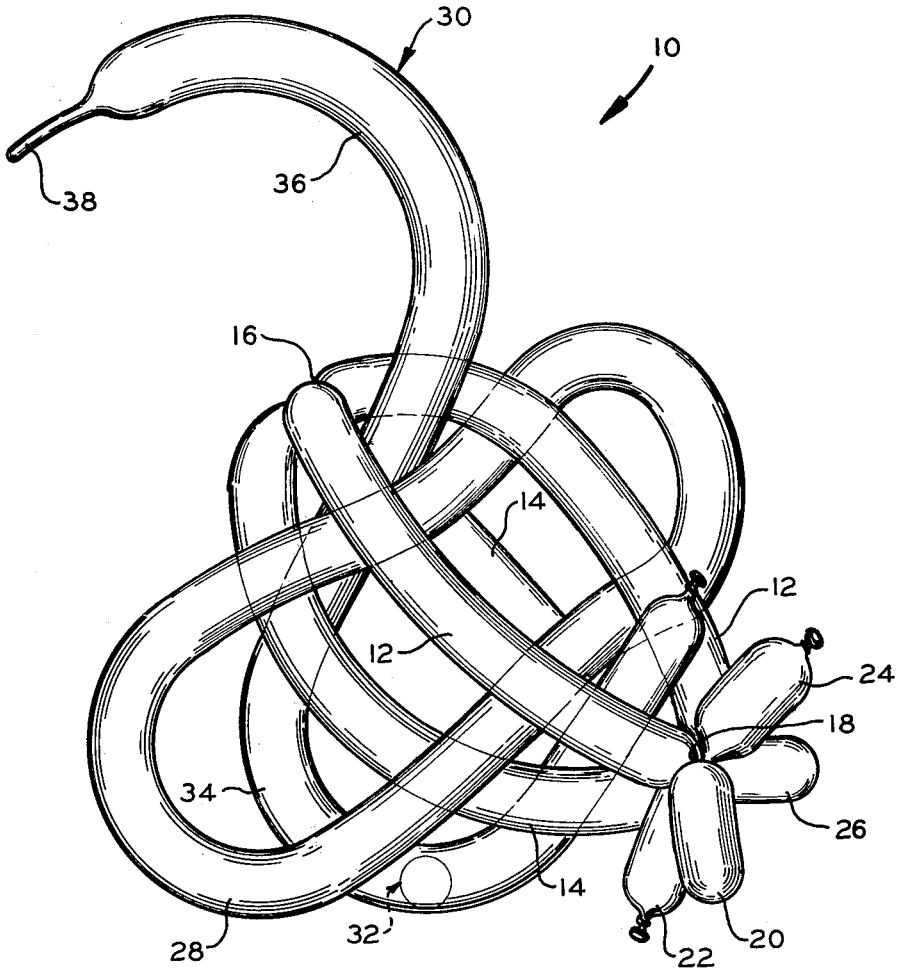
FIG. 1 is a perspective view of an avian figure embodying the features of the present invention.
Figure 2:
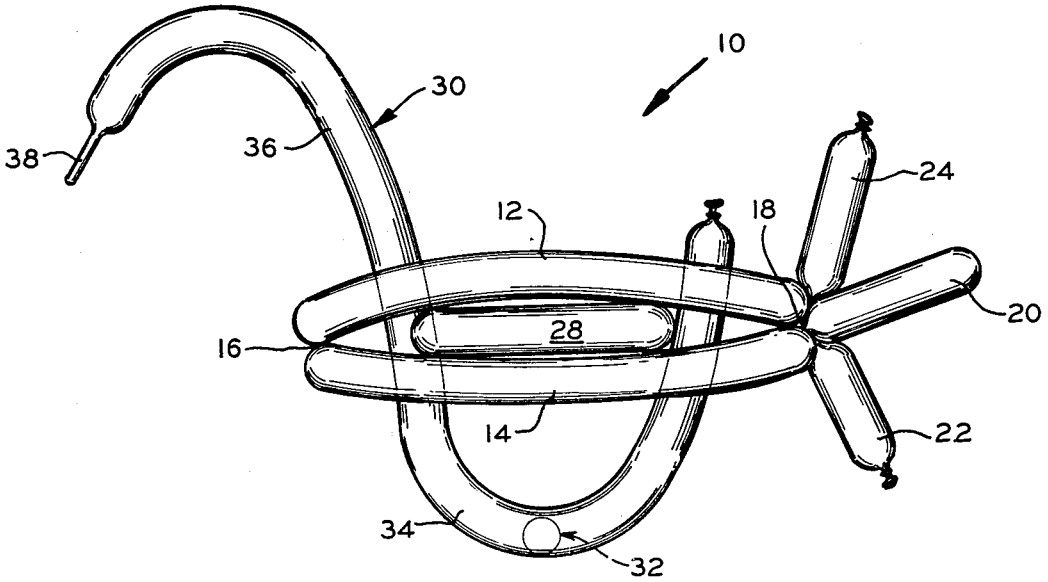
FIG. 2 is a side elevational view of the avian figure illustrated in FIG. 1.
Figure 3:
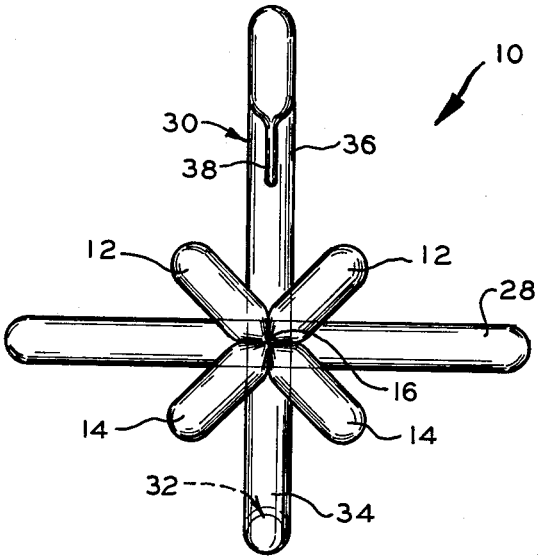
FIG. 3 is a front elevational view of the avian figure illustrated in FIG. 1.
Figure 4:
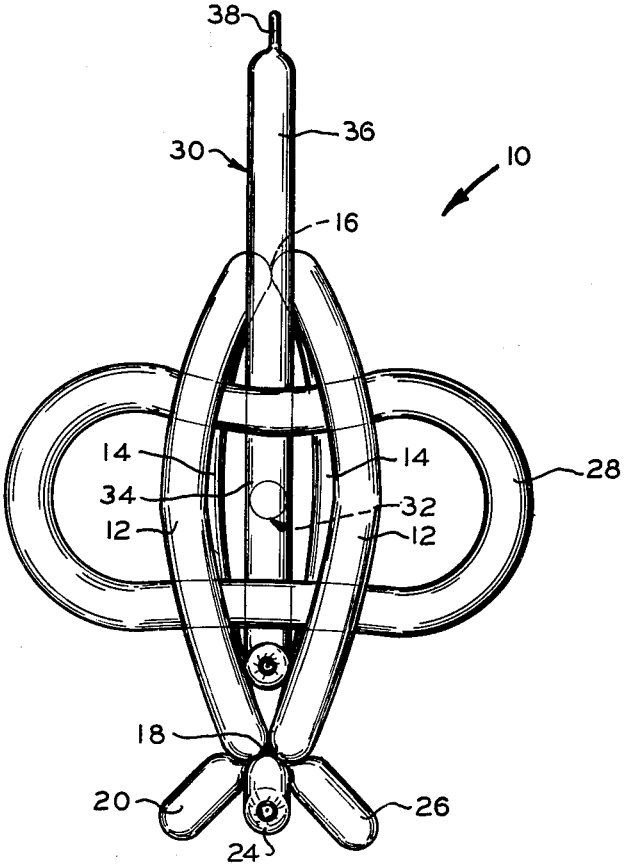
FIG. 4 is a top plan view of the avian figure illustrated in FIG. 1.
Figure 5:
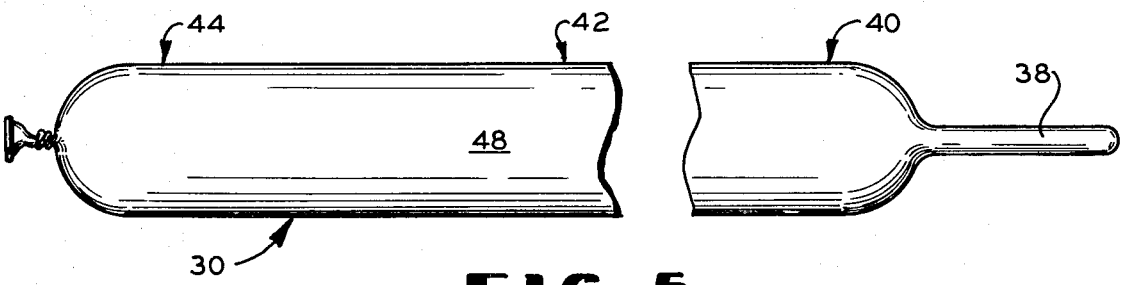
FIG. 5 is an elevational view of an elongate inflated balloon preparatory to the formation of a composite balloon element of the avian figure illustrated in FIGS. 1–4.
Figure 6:
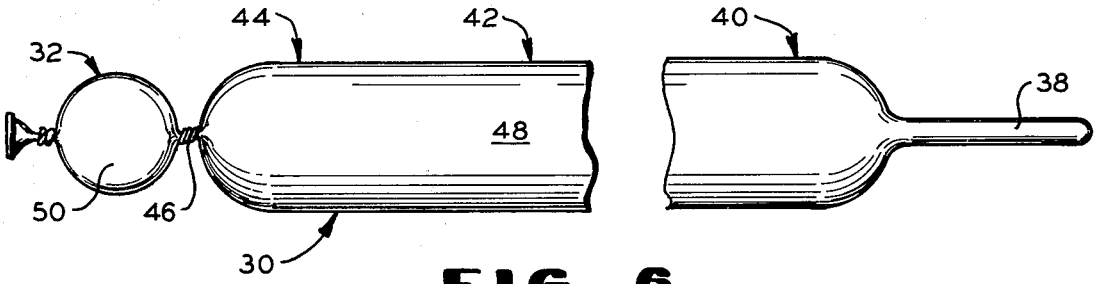
FIG. 6 is an elevational view of the balloon illustrated in FIG. 5 subsequent to the formation of parent and second balloon portions thereof.

The present invention relates to a composite balloon figure and a method of making the same. The composite balloon structure comprises a parent balloon containing a second balloon inside the parent balloon, and formed from the parent balloon. The balloon within a balloon structure is particularly useful in forming balloon representations of various avians and animals for entertainment functions, such as parties, club meetings, carnivals, fairs and the like.

FIGS. 1–4 illustrate a balloon avian FIG. 10 generally representing a goose, swan or other similar avian. To form the avian FIG. 10, a pair of resilient, elongate balloons 12 and 14 are inflated and sealed. The balloons 12 and 14 are crossed at the center of their longest axis and twisted around each other to form a front joint 16. A rear joint 18 is formed by collecting the ends of the balloons 14 and 16 near the end most distal to the front joint 16 and twisting them together. The ends 20 and 22 of the balloon 12, and the ends 24 and 26 of the balloon 14 extend outwardly from the rear joint 18.

The inflated balloons 12 and 14 represent the rib cage or chest portion of the FIG. 10, while the ends 20, 22, 24 and 26 represent the featured tail common to avians.

An elongate balloon 28 is inflated, sealed and the ends thereof are joined together to form a generally elliptical wing-like structure. The wing balloon 28 is inserted between the rib cage balloons 12 and 14 and is maintained therebetween by the natural contraction of the elastomeric material of the balloons 12 and 14. The balloons described throughout the disclosure are generally elongate, tubular, resilient balloons fabricated from an elastomeric material, such as latex rubber, by dip casting.

To complete the avian FIG. 10, an elongate parent balloon 30 is inflated, sealed and processed, as will be described in greater detail hereinafter to form a second, self sealing balloon 32 within the interior of the parent balloon 30. After the second balloon 32 is formed, the parent balloon 30 is contoured to form an abdomen 34, neck 36, and snout 38 configuration to the parent balloon 30.

The steps of the method for forming the second balloon 32 within the parent balloon 30 are illustrated in FIGS. 5–8. The elongate parent balloon 30 includes a first end 40, a middle portion 42, and a second end 44. As shown most clearly in FIG. 5, after the parent balloon 30 is inflated, the second end 44 is tied closed and the snout 38 is fashioned at the first end 40.

The small, spherical second balloon 32 is formed by squeezing the distal portion of the second end 44 together. Upon squeezing an interface region 46 of substantially reduced cross-section compared to the parent balloon 30 is formed. To maintain the air in the newly formed second balloon 32, the interface region 46 is compressed upon itself to prevent any substantial interchange of air between the internal cavity 48 of the parent balloon 30 and the internal cavity 50 of the second balloon 32. A number of suitable methods are available to compress the interface region 46, but the simplest and preferred method is to rotate the parent balloon 30 and the second balloon 32 relative to one another five or six times to form a twist seal between the parent balloon 30 and second balloon 32.

Figure 7:
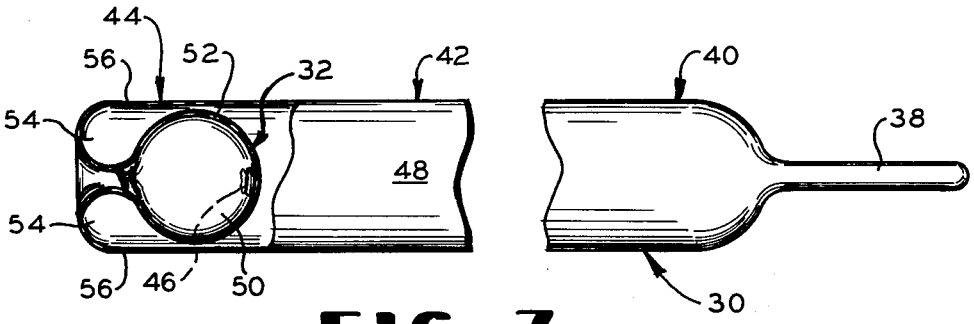
FIG. 7 is an elevational view illustrating the step of inserting the second balloon portion into the parent balloon portion and the subsequent tearing and sealing of the parent balloon.

As illustrated in FIG. 7, after the interface region 46 is sealed, the second balloon 32 is moved into the cavity 48 until it is completly enveloped inside. A fold 52 is generated at the second end 44 of the parent balloon 30, as the second balloon 32 advances into the cavity 48 of the parent balloon 30. The fold 52 covers substantially all of the outer surface or skin of the second balloon 32 since the second balloon is inside the parent balloon 30. The second balloon 32 is pushed inwardly until an annular flap 54 is formed at the end of the fold 52. Once the flap 54 is formed at the end of the fold 52, the flap 54 is torn from the parent balloon 30, along the dashed line in FIG. 7. The newly formed periphery 56 of the second end 44 of the parent balloon 30 is rapidly sealed, by tying for example, thereby producing a composite article comprising the parent balloon 30 containing the second balloon 32 in the internal cavity 48 thereof, as illustrated in FIG. 8.

Figure 8:
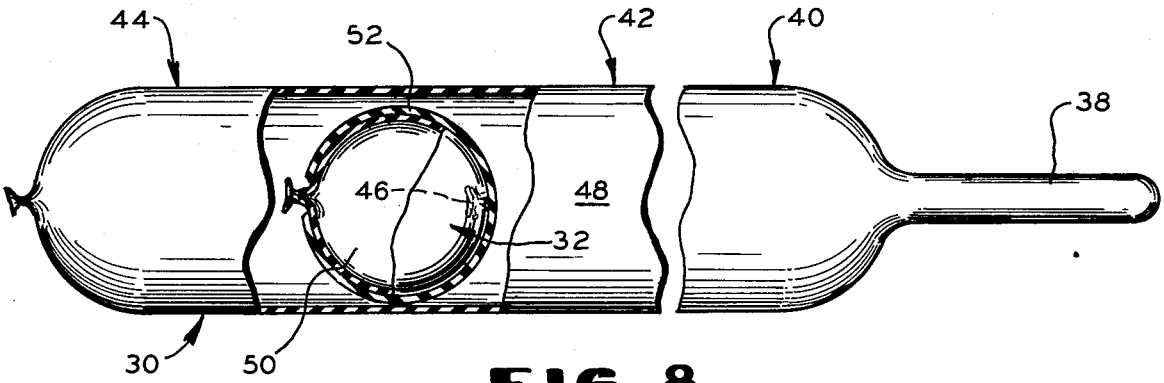
FIG. 8 is an elevational view partially in section of the completed parent and second balloon structure preparatory to being employed in another composite figure such as illustrated in FIGS. 1–4.

FIG. 8 clearly illustrates that the second balloon 32 is a complete self-sealed structure wherein the resilient skin of the fold 52 has contracted to tightly cover the outer skin of the second balloon 32. The fold 52 functions as an outer skin of the second balloon 32 to effectively contain air and enable the second balloon 32 to remain inflated for substantial periods of time.

After the second balloon 32 has been formed within the patent balloon 30, the parent balloon 30 is contoured to form the neck, snout and abdomen portions 36, 38 and 34, respectively of the avian FIG. 10.

The completed avian FIG. 10 may be used as an entertainment tool, such as, for example, depicting the "goose that laid the golden egg" in fairy tale presentations geared for young audiences.

In accordance with the provisions of the patent statutes, I have explained the principle and mode of the invention, and have illustrated and described in the typical embodiment what is considered its best embodiment. It is understood that, within the scope of the appended claims, the invention may be practiced otherwise than as specifically illustrated and described in the typical embodiment and accompanying alternatives herein.

What I claim is:

1. A method of forming a composite balloon figure having a small balloon within a parent balloon comprising the steps of:

inflating and sealing the parent balloon;

squeezing a portion of said parent balloon to form a discrete second balloon connected to said parent balloon by a substantially reduced cross-section interface region;

substantially sealing said interface region by compressing said interface region;

moving said second balloon inwardly into said parent balloon until said second balloon is entirely encased by said parent balloon;

tearing the skin of said parent balloon that is disposed adjacent to the outer end of the inserted second balloon to disengage said second balloon from said parent balloon with said second balloon remaining within said parent balloon; and sealing said parent balloon adjacent said torn skin portion with said second balloon therein.

2. The invention defined in claim 1 wherein said interface region is sealed by rotating one of said second and parent balloon relative to the other to twist the interface region into a compressive seal.

3. An inflated generally spherical balloon structure comprising a spherical balloon having a double wall thickness over more than half of its sphere formed by inflating and sealing an elongate balloon, squeezing a portion of said elongate balloon to form said spherical balloon connected to said elongate balloon, substantially sealing said connection, moving said spherical balloon completely into said elongate balloon and tearing the skin of said elongate balloon adjacent the outer end of said spherical balloon.

* * * * *